US009303320B2

(12) United States Patent
He et al.

(10) Patent No.: US 9,303,320 B2
(45) Date of Patent: Apr. 5, 2016

(54) HYDRIDING OF METALLIC SUBSTRATES

(71) Applicant: Southwest Research Institute, San Antonio, TX (US)

(72) Inventors: Xihua He, San Antonio, TX (US); Maoqi Feng, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 471 days.

(21) Appl. No.: 14/168,558

(22) Filed: Jan. 30, 2014

(65) Prior Publication Data

US 2015/0211103 A1 Jul. 30, 2015

(51) Int. Cl.

| | |
|---|---|
| ***C23C 8/10*** | (2006.01) |
| ***C23C 18/34*** | (2006.01) |
| ***C23C 18/16*** | (2006.01) |
| ***C23C 18/40*** | (2006.01) |
| ***C23C 18/44*** | (2006.01) |
| *G21C 3/00* | (2006.01) |

(52) U.S. Cl.

CPC ..... *C23C 18/34* (2013.01); *C23C 18/1689* (2013.01); *C23C 18/40* (2013.01); *C23C 18/44* (2013.01)

(58) Field of Classification Search

CPC ..... C23C 8/00; G21C 3/00

USPC ..... 376/416–417; 148/634

See application file for complete search history.

(56) References Cited

PUBLICATIONS

Dryden, N.H., et al. "Chemical Vapor Deposition of Platinum: New Precursors and Their Properties."; Chemistry Materials, vol. 3. pp. 677-685. 1991.

Ferrin, P., et al., "Hydrogen Adsorption, Absorption and Diffusion on and in Transition Metal Surfaces: A DFR Study"; Surface Science 606 (2012), pp. 679-689.

Hanson B., et al. "Gap Analysis to Support Extended Storage of Used Nuclear Fuel"; Fuel Cycle R & D, Used Fuel Disposition Campaign; FCRD-USED-2011-000136. PNNL-20509. Rev. 0. Richland, Washington: Pacific Northwest National Laboratory. 2012.

Kristinsdottir, L., et al.; "A Systematic DFT Study of Hydrogen Diffusion on Transition Metal Surfaces"; Surface Science vol. 606, pp. 1400-1404. 2012.

Mardon, J.P. et al, "Update on the Development of Advanced Zirconium Alloys for PWR Fuel Rod Claddings"; Proceedings of the 1997 International Topical Meeting on LWR Fuel Performance, Portland Oregon; American Nuclear Society, pp. 405-412.

Pierron, O.N., et al.; "The Influence of Hydride Blisters on the Fracture of Zircaloy-4"; Journal of Nuclear Materials, vol. 322, pp. 21-35. 2003.

Sindelar, R.L., et al, Materials Aging Issues and Aging Management for Extended Storage and Transportation of Spent Nuclear Fuels; US NUREG/CR-7116; SRNL-STI-2011-00005, Washington D.C.

Suh, M.P, et al.; "Hydrogen Storage in Metal-Organic Frameworks"; ACS Publications; Chem. Rev. vol. 112, pp. 782-835. 2012.

(Continued)

*Primary Examiner* — Lois Zheng

(74) *Attorney, Agent, or Firm* — Grossman, Tucker et al

(57) ABSTRACT

The present disclosure relates to a method for accelerated hydriding of metallic substrates to evaluate the effects of hydrogen adsorption on substrate performance. The method includes applying to the substrate a metal that has an activation energy for hydrogen adsorption that is lower than the substrate activation energy for hydrogen adsorption. This is then followed by hydriding and evaluation of the effects of hydriding on substrate mechanical properties.

18 Claims, 8 Drawing Sheets

(56) References Cited

PUBLICATIONS

Une, K., et al.; "The Terminal Solid Solubility of Hydrogen in Irradiated Zircaloy-2 and Microscopic Modeling of Hydride Behavior"; Journal of Nuclear Materials. vol. 389. pp. 127-136. 2009.

Viguié, J.C., et al.; "Chemical Vapor Deposition at Low Temperatures"; Journal of the Electrochemical Society: Solid-State Science and Technology. vol. 122, No. 4 pp. 585-588. 1975.

Zhang, Y., et al.; "Preparation and Characterization of Ruthenium/Carbon Aerogel Nanocomposites via a Supercritical Fluid Route"; Journal of Physical Chemistry, B 2005.vol. 109, pp. 2617-2624.

Olander, D.R., et al. "Chemical Processes in Defective LWR Fuel Rods"; Journal of Nuclear Materials, vol. 248, pp. 214-219, 1997.

HYDRIDING OF METALLIC SUBSTRATES

FIELD OF THE INVENTION

The present invention relates to accelerated hydriding of metallic substrates to evaluate the effects of hydrogen adsorption on substrate performance, and in particular, as cladding materials for handling, storage and transfer of nuclear fuels.

BACKGROUND

Zirconium alloys have been used as nuclear fuel cladding material in fuel assemblies for nuclear power reactors due to their relatively low neutron cross section and high corrosion resistance. Two zirconium alloy groups, including the traditional Zircaloy-2™ in boiling water reactors and Zircaloy-4™ in pressurized water reactors (PWR) have been used as cladding material. Newer materials, such as ZIRLO™ (Zr-1Nb-1Sn-0.1Fe in wt %) and M5® (Zr-1Nb-0.04Fe in wt %) have also been evaluated. During reactor operations, the cladding typically undergoes outer surface corrosion as high temperature water reacts with the cladding producing hydrogen. A fraction of this hydrogen is then absorbed by the cladding. The total hydrogen concentration generally depends on temperature, fuel burn-up, and material type. The hydrogen concentration could be up to 600 ppm. J. P. Mardon et al, *Update on the Development of Advanced Zirconium Alloys for PWR Fuel Rod Claddings,* Proceedings of the 1997 International Topical Meeting on LWR Fuel Performance, Portland Oreg., La Grange Park, Ill.: American Nuclear Society, pp. 405-412.

During extended dry storage, cladding plays an important role in safely handling, storing, and transferring spent nuclear fuel. As the cladding cools with time during extended storage, the hydrogen inside the cladding may precipitate as hydrides because the solubility of hydrogen in zirconium decreases with temperature. Furthermore, both existing and newly formed hydrides may reorient. Depending on size, distribution, and orientation, these hydrides may induce premature fracture as a result of hydride embrittlement or delayed hydride cracking. Hydride embrittlement and reorientation of spent nuclear fuel cladding is therefore a potentially significant operational and safety concern.

As the industry has considered extended dry storage as an alternative approach to manage the spent nuclear fuel and the amount of high burn-up fuel is increasing as a result of changes in plant operating conditions, there is a need to evaluate the effects of hydriding on metallic substrate materials. See, e.g., R. L. Sindelar et al, *Materials Aging Issues and Aging Management for Extended Storage and Transportation of Spent Nuclear Fuels,* NUREG/CR-7116; SRNL-STI-2011-00005, Washington D.C.

Traditional methods of hydriding using electrochemical charging followed by annealing and charging in hydrogen gas are relatively time-consuming involving multiple steps where several days are required and the hydrides must be processed at high temperature (e.g., 300° C.).

Accelerated hydriding methods that can be operated at relatively lower temperature would be very important for selection and evaluation of metallic materials for cladding applications. In addition, hydriding at relatively lower temperatures could be extended to other applications such as evaluating hydrogen embrittlement of oil and gas pipeline materials.

SUMMARY

A method for accelerated hydriding of a metallic substrate comprising supplying a metallic substrate wherein said metal substrate has an activation energy for hydrogen adsorption ($Ea_{substrate}$). This may then be followed by cleaning the substrate surface by etching with an acid and then coating at least a portion of the substrate surface with a metal having an activation energy for hydrogen adsorption ($Ea_{metal}$) that is lower than $Ea_{substrate}$. This is then followed by hydriding the substrate at a temperature of less than or equal 500° C. and for a period of less than or equal to 24 hours wherein the hydriding occurs in the metallic substrate.

DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

The present invention relates to accelerated hydriding of metallic substrate materials. The metallic substrate materials may therefore include any metal capable of hydrogen absorption wherein the influence of hydrogen absorption is to be evaluated. Metal substrates may therefore include transition metals such as Ag, Au, Co, Cr, Cu, Fe, Ir, Mo, Nb, Ni, Os, Pd, Pt, Re, Rh, Su, Sc, Ta, Ti, V, W Y and Zr. Alloys of all such metals are also contemplated. Preferred metal substrates include Zr, Ti, Ni, Ta and alloys thereof. Particularly preferred herein for accelerated hydriding are Zr type alloys, such as Zircaloy-2™ and Zircaloy-4™. Zircaloy-2™ typically contains about 1.4 wt. % tin, 0.15 wt. % iron, 0.1 wt. % chromium and 0.06 wt. % nickel, 1,000 ppm oxygen and the balance zirconium. Zircaloy-4™ typically contains about 1.4 wt. % tin, 0.21 wt. % iron, 0.11 wt. % chromium, 30 ppm nickel, 1,200 ppm oxygen and the balance zirconium.

Figure 1:
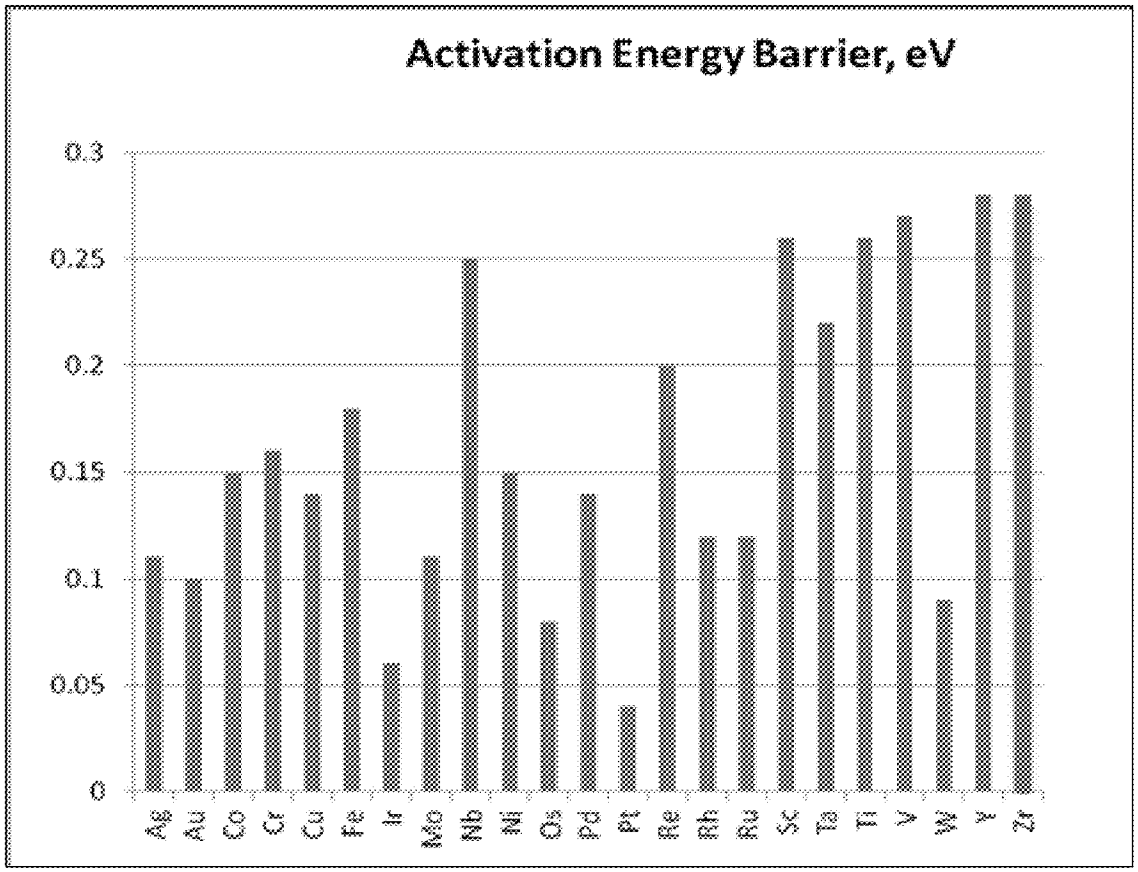
FIG. 1 compares the activation energies (Ea) for hydrogen adsorption in electron volts (eV) for the identified metals.

FIG. 1 compares the activation energies for hydrogen adsorption in electron volts (eV) for the identified metals. As can be observed, the activation energy barrier for hydrogen adsorption on Zr is relatively higher than that of metals such as Co, Cu, Ni, Pd or Pt. Accordingly, deposition of any one of these metals on Zr or a Zr alloy will now uniquely provide for acceleration of hydrogen adsorption on the Zr or Zr based alloy to facilitate the ability to evaluate the effects of hydrogen adsorption on Zr or Zr based alloys in a much more efficient manner.

In such regard, it may now be appreciated that one may now identify a substrate containing a metallic alloy (two or more metals) and then identify the activation energies for hydrogen adsorption for each of the metals within such alloy. Then, one may select for surface treatment a metal that has a relatively lower activation energy for hydrogen adsorption than any one of the metals of the substrate alloy. In this manner, accelerated hydrogen adsorption can be achieved and the evaluation of the effects of such hydrogen adsorption on the substrate alloy is more readily available. In addition, in that situation where the underlying metal substrate contains or consists of only one single metal, activation of the surface for hydriding comprises the selection of a metal that has an activation energy for hydrogen adsorption that is lower than such single metal based substrate material.

It is useful to note that the activation energies (Ea) that one may utilize and compare may be activation energies that are either measured or calculated for a given metal. In addition, the activation energies that one may consider herein may include activation energies for hydrogen diffusion from the surface to a subsurface or the activation energy from a $1^{st}$ to $2^{nd}$ subsurface of the metal at issue. See, e.g., *Hydrogen Adsorption, Absorption and Diffusion On and In Transition Metal Surfaces,* Ferrin et al, Surface Science 606 (2012) 679-689; *A Systematic DFT Study of Hydrogen Diffusion on Transition Metal Surfaces,* Kristinsdóttir et al, Surface Science 606 (2012) 1400-1404. For the purpose of the present disclosure, when considering activation energies of either the substrate or the activating metal layer, one should be consistent in the selection criterion (e.g. compare activation energies of hydrogen diffusion for the surface to a subsurface for a given metal substrate and given surface activating metal or compare activation energies of hydrogen diffusion from a $1^{st}$ subsurface to a $2^{nd}$ subsurface for a given substrate and activating metal to be applied thereto).

Figure 2:
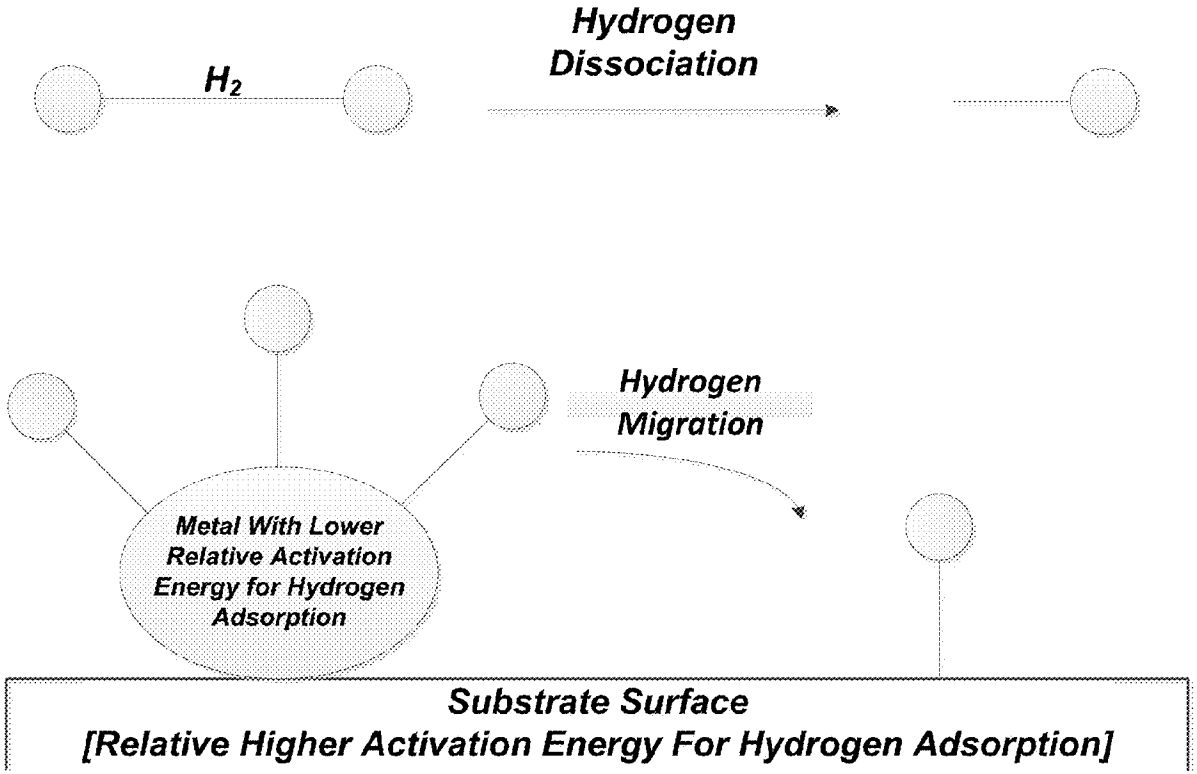
FIG. 2 identifies hydrogen storage, migration and diffusion into a given substrate surface in connection with the observed accelerated hydriding disclosed herein.

The present invention therefore discloses and identifies a method for reducing the time and temperature that is necessary for hydriding of a selected metal substrate. Without being bound by any particular theory, attention is directed to FIG. 2 which identifies what is believed to reflect one potential model of hydrogen storage, migration and diffusion into a given substrate surface, in connection with the observed accelerated hydriding disclosed herein. As can be seen, one may partially coat the substrate surface. For example, one may partially coat 1-90% of the available substrate surface. More preferably, one may coat 1-80%, 1-70%, 1-60%, 1-50%, 1-40%, or 1-30% of said substrate surface. Accordingly, one may therefore now coat only 50% or less of the substrate surface with an activating metal and still provide herein a useful procedure to more effectively evaluate the effect of hydrogen adsorption on the underlying substrate by triggering hydrogen adsorption at temperatures and times that are less than what would be otherwise necessary to hydrate a given substrate. As illustrated in FIG. 2, the hydrogen that is adsorbed on the surface of the accelerating metal deposited on the substrate surface may then migrate to the substrate surface for ensuing hydrogen adsorption.

However, in the broad context of the present invention, one may also activate the surface herein by fully coating (100%) the substrate surface with a metal with the relatively lower activation energy (Ea) for hydrogen absorption. Preferably, the thickness of the metal layer applied to the substrate for surface activation for hydrogen adsorption, whether a partial or full coating, falls in the range of 5.0-100 nm.

In particular, it has now been observed that by activation of the surface of a metal substrate to hydriding herein, hydrogen adsorption may now proceed at temperatures in the range of 50° C. to 500° C. More preferably, hydriding can now be made to occur for a selected metal substrate at temperatures of 50° C. to 300° C. In addition, the time period to effect hydriding of the underlying substrate is now reduced to a period of up to 24 hours, preferably within a period of 2-12 hours.

Figure 3:
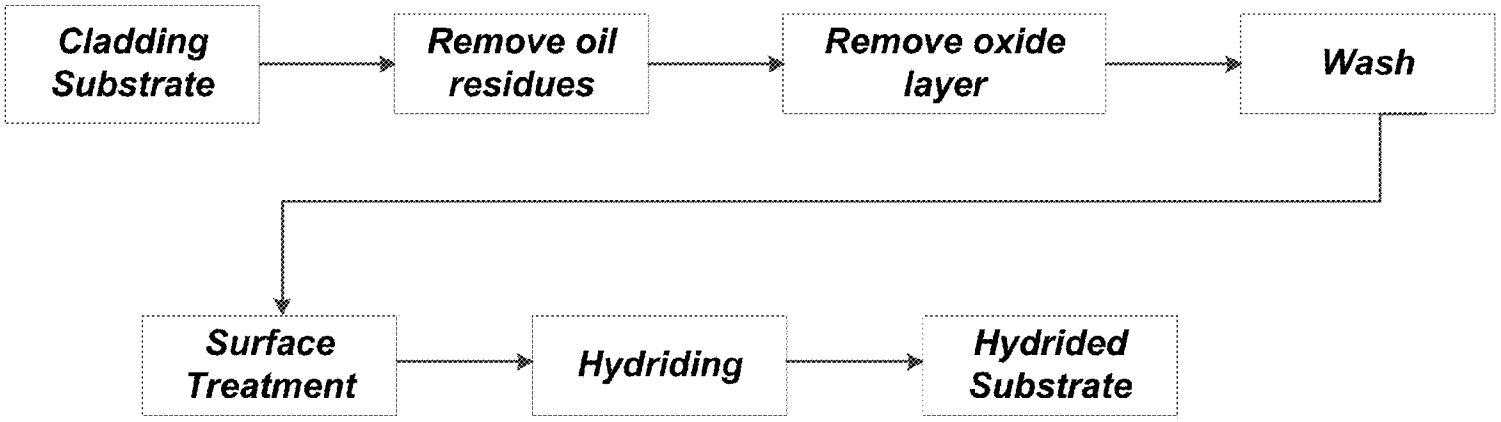
FIG. 3 outlines a preferred procedure for accelerated hydriding of a metal substrate.

Attention is next directed to FIG. 3 which outlines a preferred procedure for accelerated hydriding of a metal substrate. Initially, for a selected cladding substrate (metal substrate that is used, e.g., as a liner for a nuclear power reactor) one initially removes any oil residues by treatment with organic solvent. This is then followed by removal of any oxide layer which preferably can be achieved by treatment with inorganic acids, such as nitric acid (HNO3) or hydrofluoric acid (HF) or a mixture thereof where each inorganic acid present at 20 wt. % in aqueous solution. The substrate surface is then washed with deionized water and surface treatment (surface activation for hydriding) is then applied. Surface treatment may be achieved by any one of the following three preferred steps. First, one can expose the substrate to a solution of an inorganic metal salt. In this situation, as noted herein, the metal component of the metal salt is one that has a relatively lower activation energy for hydrogen adsorption than the substrate surface which will be activated. Examples of suitable salts include nickel chloride ($NiCl_2$), cobalt nitrate $[Co(NO_3)_2]$, copper chloride ($CuCl_2$), palladium chloride ($PdCl_2$)and organometallic salts such as 1,5-cyclooctadiene platinum II. It also should be noted that one of the advantages of surface treatment with metal salts is that after treatment and surface activation, upon exposure to hydrogen, the metal salts themselves are reduced to metal elements which facilitates hydrogen adsorption and diffusion to the substrate surface.

A second procedure for surface activation for hydriding includes electroless deposition of a layer of the metal having the lower relative activation energy for hydrogen adsorption. Electroless deposition is reference to the use of a redox reaction to deposit the selected metal without the passage of an electric current. For example, Ag may be deposited according to the following reaction:

$$R{-}CHO+2[Ag(NH_3)_2]OH \rightarrow 2Ag(s)+RCOONH_4+H_2O+3NH_3$$

Accordingly, electroless plating may be conveniently employed herein to deposit metals as copper, nickel, silver, gold, or palladium on the substrate surface by means of a reducing chemical bath. This may then be followed by accelerated hydriding and evaluation of the hydriding on the underlying substrate.

A third method for activation of a substrate surface for hydriding involves treatment of the substrate surface with a solution of a metal β-diketonate complex (metal acetylacetonate):

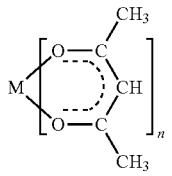

It may be appreciated that M in the above formula may comprise transition metal identified in FIG. 1 wherein as noted above, the metal selected is one that has a relatively lower activation for hydrogen adsorption than the particular metal substrate at issue. Or, in the case, of a metal substrate that is of alloy composition (mixture of metals), M in the above is selected from a transition metal that has a lower activation energy for hydrogen adsorption than any one of the metals present in the substrate alloy. The value of n in the above formula is typically 3.

One may therefore preferably employ iron acetylacetonates, nickel acetylacetonate, copper acetylacetonate or cobalt acetylacetonates. More specifically, one may preferably employ (1,5-cyclooctadiene) dimethyl platinum (II) or bis(1,5-cyclooctadiene) nickel (0).

EXAMPLE 1

Figure 4:
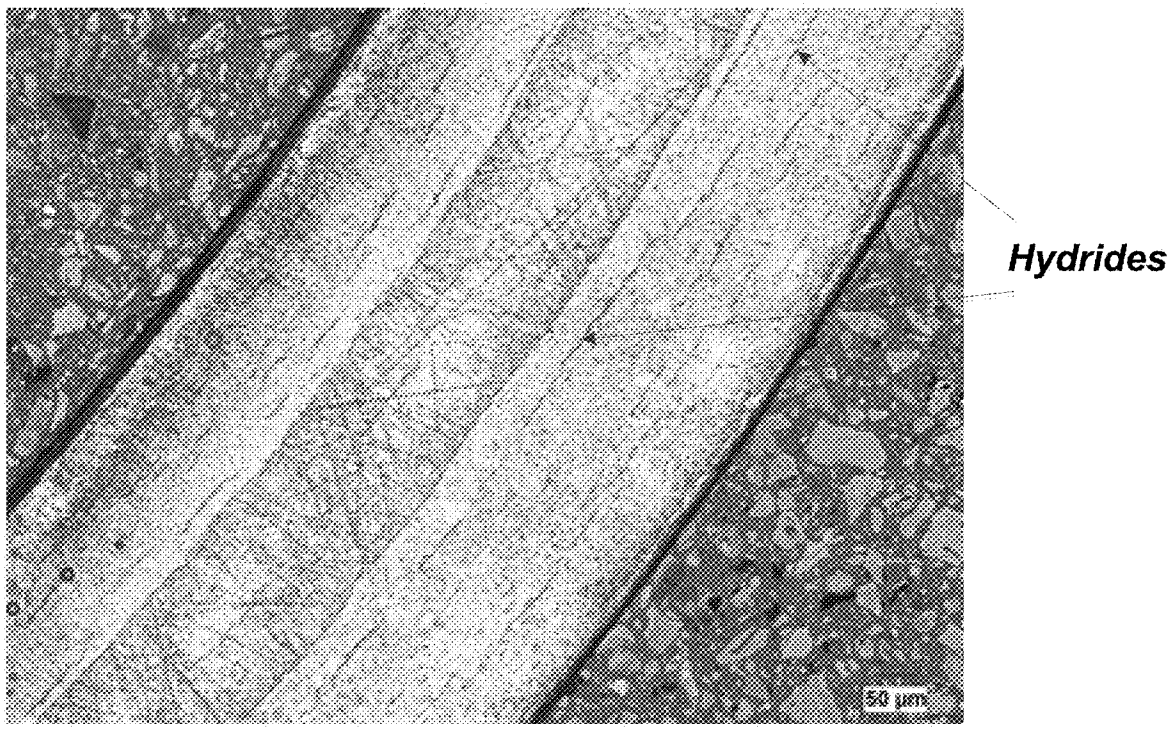
FIG. 4 identifies a cross-section of the Zircaloy-2™ alloy after etching to highlight the hydride formation.

A Zircaloy-2™ alloy was selected as the substrate material and for comparison purposes. An electrochemical method was employed wherein the alloy was hydrided by cathodic charging followed by diffusion annealing. The annealing took place at a temperature of 400° C. for a period of two hours. FIG. 4 is a cross-section of the Zircaloy-2™ alloy after etching to highlight the hydride formation.

EXAMPLE 2

A Zircaloy-2™ alloy was employed as the substrate. After the oxide layer was removed by acid etching as noted herein the clean Zircaloy-2 surface was activated by treatment of the substrate surface with a solution of a metal β-diketonate complex (metal acetylacetonate), as noted above. After hydriding at noted above, the surface layers were removed by polishing. Test samples were cut into shapes approximately 4 mm square and 0.5 mm thick, weighing about 40-50 mg.

For characterization purposes, it is noted that differential scanning calorimetry (DSC) has been previously used to measure what it understood as the terminal solid solubility (TSS) of hydrogen over the temperature range of 50° C.-600° C. The TSS dissolution curve defines the temperature (TSSD) and hydrogen concentration condition for dissolution of hydrides on warmup. The precipitation curve defines the temperature (TSSP) and hydrogen concentration conditions for hydride precipitation on cooldown. See, *The Terminal Solid Solubility Of Hydrogen in Irradiated Zircaloy-2 and Microscopic Modeling of Hydride Behavior,* Une et al, Journal of Nuclear Materials 389 (2009) 127-136.

Figure 5:
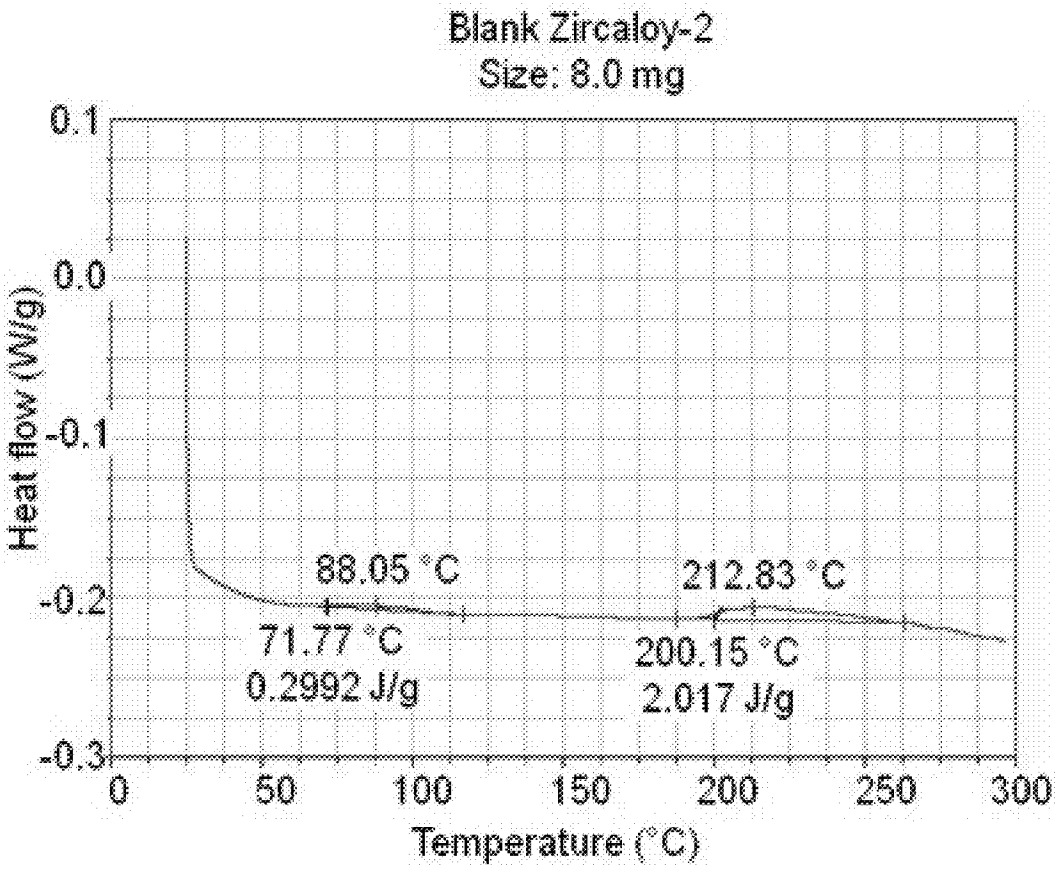
FIG. 5 shows the DSC results for a blank Zircaloy-2 (no surface activation and no hydriding).
Figure 6:
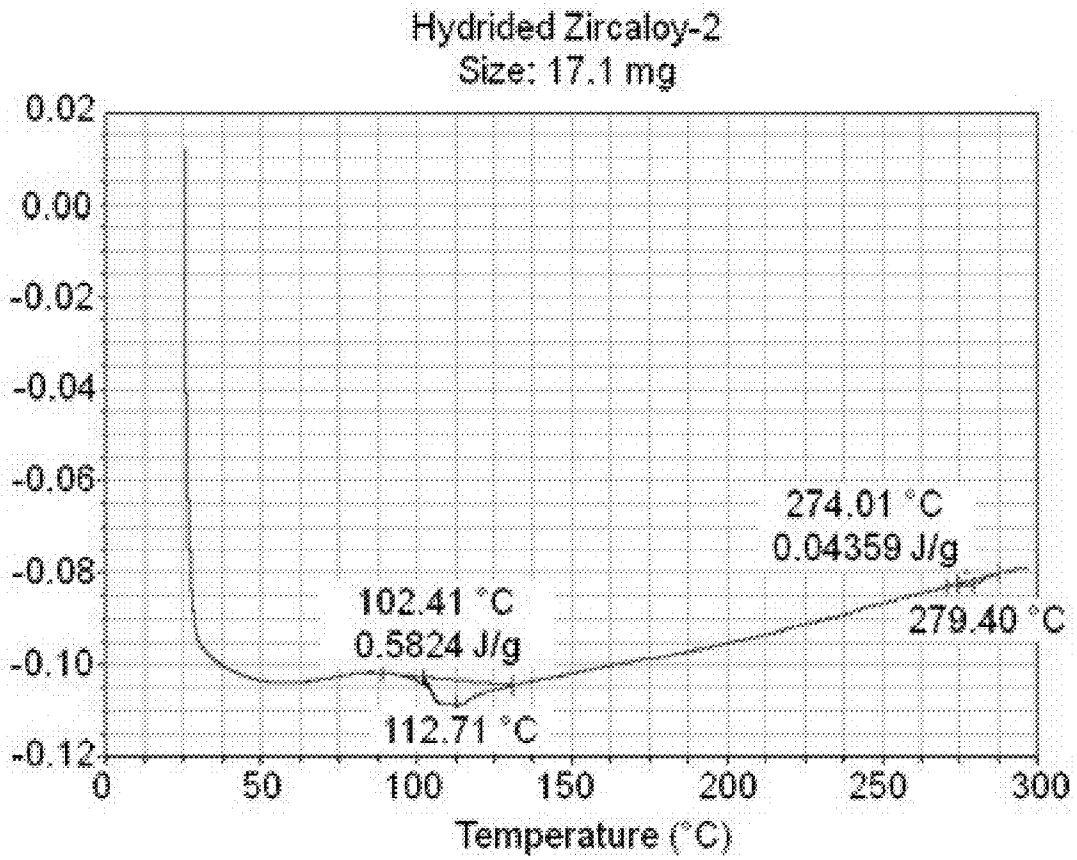
FIG. 6 shows the DSC results the Zircaloy-2 alloy treated with a nickel β-diketonate complex for surface activation for hydrogen adsorption.

FIG. 5 shows the DSC results for a blank Zircaloy-2 (no surface activation and no hydriding). FIG. 6 shows the results the Zircaloy-2 alloy treated with a nickel β-diketonate complex. An endothermic peak is observed at 279.4° C. which is assigned as the TSSP temperature.

Figure 7:
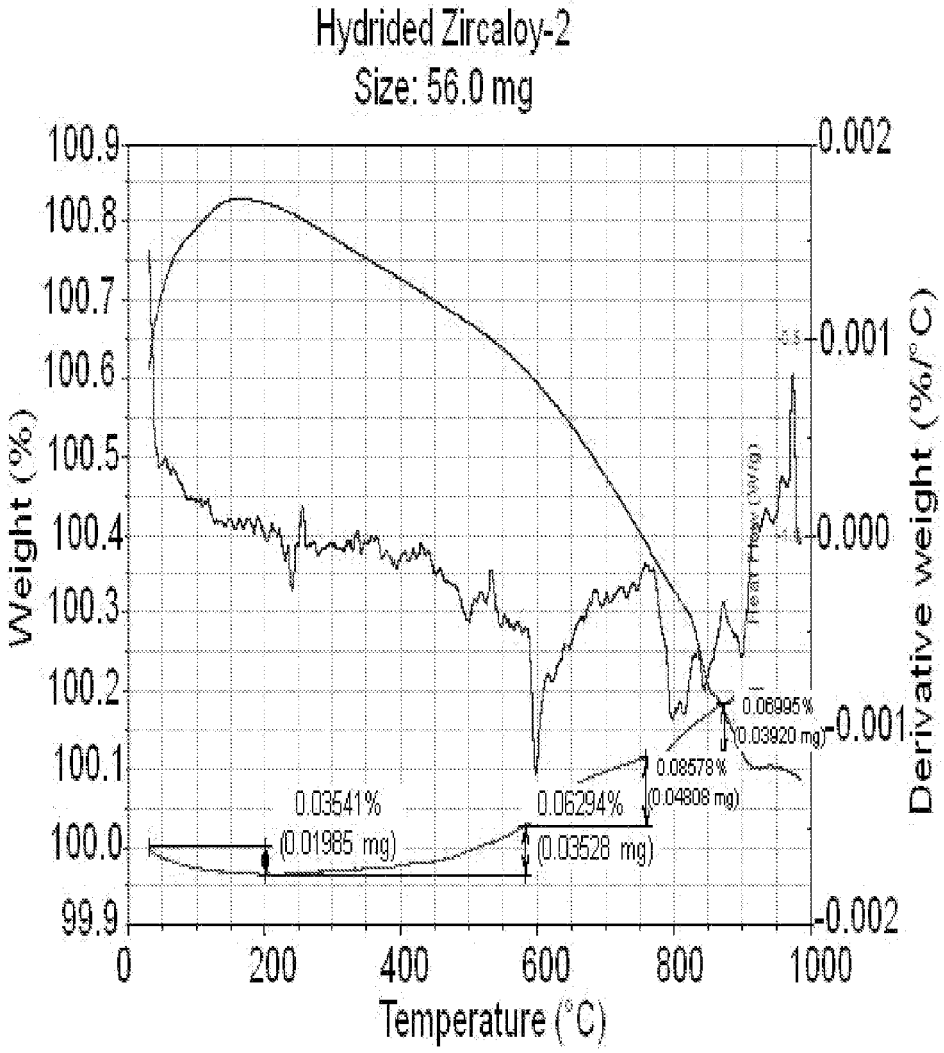
FIG. 7 provides the results of TGA testing of a hydrided Zircoloy-2 alloy employing nickel β-diketonate for activation.
Figure 8:
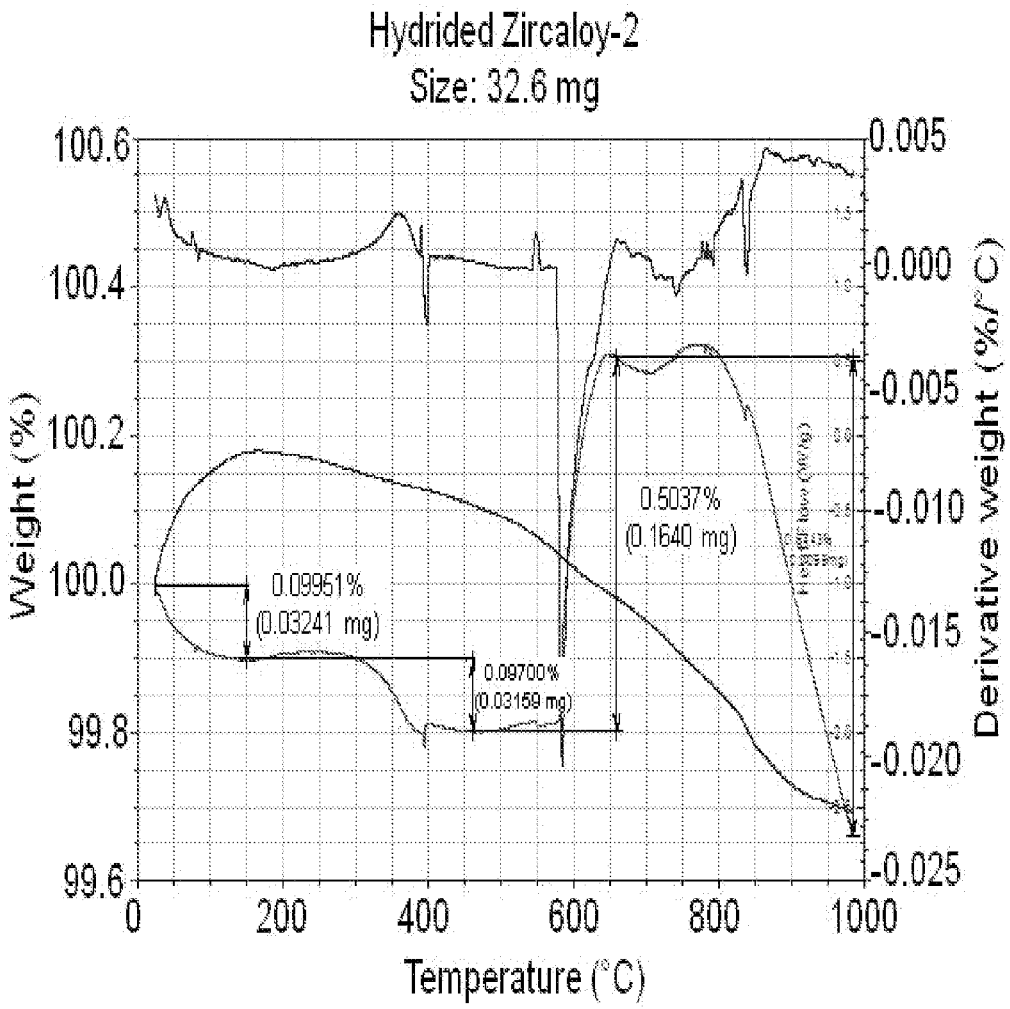
FIG. 8 provides the results of TGA testing of a hydrided Zircoloy-2 alloy employing palladium β-diketonate for activation and after hydriding in supercritical water.

As an additional characterization procedure, one may employ weight loss by thermogravimetric analysis (TGA). Test specimens were run from room temperature to 1000° C. at 20° C./minute with a 100 ml/min nitrogen purge gas. FIG. 7 provides the results of TGA testing of a hydrided Zircoloy-2 alloy employing nickel as the activating metal. Hydriding was achieved by charging the surface with pure hydrogen in a pressurized tubular reactor for 3 minutes and then pressurized to 200 psig and heated to 300° C. for 12 hours. In FIG. 7, from 580 to 770° C., the weight loss was 0.08578%, or 857.8 ppm; from 750 to 1000° C., the weight loss was 0.06996%, or 699.6 ppm. In FIG. 8, hydriding initially took place in supercritical water in a pressurized tubular reaction pressurized to 200 psig and heated to 300 C for 12 hours. During the ensuing TGA analysis a weight loss was 0.5% was observed at the temperature range of 570-650° C. Weight losses at these ranges of temperatures are believed to be indicative of hydriding.

Hydrogen analysis was next conducted along with one sample without surface activation. The results are summarized below for treatment of a Zircaloy-2 alloy:

Measured Hydrogen Content Of Activated & Non-Activated Zircaloy-2 ™ Alloys

| Surface Activation of Zircaloy-2 ™ Alloy | Hydrogen Content (ppm) |
|---|---|
| Activation by dimethyl 1,5-cyclooctadiene platinum (II) ($CODPtMe_2$) | 476 |
| Activated by $PdCl_2$ | 35 |
| No Activation | 21 |

As can be seen from the above table, surface activation of the Zircaloy-2™ alloy by treatment of $CODPtMe_2$ provided for relatively high hydrogen concentration after hydriding. Activation with $PdCl_2$ was relatively lower, but still provided a higher hydrogen concentration of the non-activated Zircaloy-2™ alloy surface.

The penetration of hydrogen into the bulk of a metal alloy causing embrittlement is an important metallurgical condition that is important to monitor and evaluation. The present invention confirms that in the case of an underlying metallic substrate, such as an alloy employed in as a cladding material in a nuclear power reactor, one may now accelerate the hydriding of such cladding at relatively low temperatures and at periods of less than or equal to a maximum of 24 hours in order to more effectively evaluate the effects of hydriding on cladding performance. As noted, since hydriding will tend to cause fracture and embrittlement, the present invention provides for the ability to more efficiently evaluate the operational performance of a given cladding material and provide for a more reliable prediction of expected cladding lifetime.

What is claimed is:

1. A method for accelerated hydriding of a metallic substrate comprising:

supplying a metallic substrate wherein said metal substrate has an activation energy for hydrogen adsorption ($Ea_{substrate}$);

cleaning the substrate surface by etching with an acid;

coating at least a portion of a substrate surface of the metallic substrate with a metal having an activation energy for hydrogen adsorption ($Ea_{metal}$) that is lower than $Ea_{substrate}$;

hydriding the coated substrate at a temperature of less than or equal 500°C. and for a period of less than or equal to 24 hours;

wherein said hydriding occurs in said metallic substrate.

2. The method of claim 1 wherein the metallic substrate comprises a metal selected from the group consisting of Ag, Au, Co, Cr, Cu, Fe, Ir, Mo, Nb, Ni, Os, Pd, Pt, Re, Rh, Su, Sc, Ta, Ti, V, W Y or Zr.

3. The method of claim 1 wherein the metallic substrate comprises a Zr alloy comprising containing tin, iron, chromium, nickel, and oxygen.

4. The method of claim 1 wherein said metallic substrate consists of a single metal having an activation energy for hydrogen adsorption and said metal in said coating has an activation energy for hydrogen adsorption that is less than said activation energy of said single metal substrate.

5. The method of claim 1 wherein said metallic substrate comprises a metal alloy where each metal in said alloy has an activation energy for hydrogen adsorption and said metal in said coating having an activation energy for hydrogen adsorption ($Ea_{metal}$)having an activation energy for hydrogen adsorption that is lower than any one of the metals in said metal alloy substrate.

6. The method of claim 1 wherein the coating of said metallic substrate surface with a metal having an activation energy for hydrogen adsorption ($Ea_{metal}$) that is lower than $Ea_{substrate}$ comprises treatment of the metallic substrate surface with a metal P-diketonate complex of the following formula:

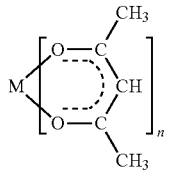

wherein M is a transition metal having said $Ea_{metal}$ that is less than $Ea_{substrate}$.

7. The method of claim 1 wherein the coating of said metallic substrate with a metal having an activation energy for hydrogen adsorption ($Ea_{metal}$) that is lower than $Ea_{substrate}$ comprises treatment of the metallic substrate surface with (1,5-cyclooctadiene) dimethyl platinum (II).

8. The method of claim 1 wherein the coating of said metallic substrate with a metal having an activation energy for hydrogen adsorption ($Ea_{metal}$) that is lower than $Ea_{substrate}$ comprises treatment of the metallic substrate surface with bis (1,5-cyclooctadiene) nickel (0).

9. The method of claim 6 wherein said metallic substrate comprises a Zr alloy comprising containing tin, iron, chromium, nickel, and oxygen.

10. The method of claim 9 wherein said coating containing a metal having an activation energy for hydrogen adsorption ($Ea_{metal}$) that is less than $Ea_{substrate}$ comprises a metal selected from Co, Cu, Ni, Pd or Pt.

11. The method of claim 1 wherein said portion of said substrate surface that is coated with said metal comprises 1-90% of said substrate surface.

12. The method of claim 1 wherein said portion of said substrate surface that is coated with said metal comprises 1-80% of said substrate surface.

13. The method of claim 1 wherein said portion of said substrate surface that is coated with said metal comprises 1-70% of said substrate surface.

14. The method of claim 1 wherein said portion of said substrate surface that is coated with said metal comprises 1-60% of said substrate surface.

15. The method of claim 1 wherein said portion of said substrate surface that is coated with said metal comprises 1-50% of said substrate surface.

16. The method of claim 1 wherein said hydriding of said substrate is carried out at a temperature of 50° C. to 500° C.

17. The method of claim 1 wherein said hydriding of said substrate is carried out at a temperature of 50° C. to 300° C.

18. The method of claim 1 wherein said hydriding of said substrate is carried out at a temperature of 50° C. to 300° C. for a period of 2-24 hours.

* * * * *